US012006936B2

(12) United States Patent
Hu et al.

(10) Patent No.: US 12,006,936 B2
(45) Date of Patent: Jun. 11, 2024

(54) ORBITING SCROLL PLATE DRIVING ASSEMBLY AND SCROLL COMPRESSOR

(71) Applicant: GREE GREEN REFRIGERATION TECHNOLOGY CENTER CO., LTD. OF ZHUHAI, Qianshan Zhuhai (CN)

(72) Inventors: Yusheng Hu, Zhuhai (CN); Huijun Wei, Zhuhai (CN); Yun Liu, Zhuhai (CN); Shuanglai Liu, Zhuhai (CN); Caixia Shan, Zhuhai (CN); Xiaoli Kang, Zhuhai (CN); Xuefeng Li, Zhuhai (CN); Xiaoshan Chen, Zhuhai (CN)

(73) Assignee: Gree Green Refrigeration Technology Center Co., Ltd. of Zhuhai, Zhuhai (CN)

( * ) Notice: Subject to any disclaimer, the term of this patent is extended or adjusted under 35 U.S.C. 154(b) by 43 days.

(21) Appl. No.: 17/620,626

(22) PCT Filed: Jun. 30, 2020

(86) PCT No.: PCT/CN2020/099273

§ 371 (c)(1),
(2) Date: Dec. 17, 2021

(87) PCT Pub. No.: WO2021/004332

PCT Pub. Date: Jan. 14, 2021

(65) Prior Publication Data

US 2022/0260076 A1 Aug. 18, 2022

(30) Foreign Application Priority Data

Jul. 8, 2019 (CN) ..... 201910611799.0

(51) Int. Cl.
*F04C 29/00* (2006.01)
*F04C 18/02* (2006.01)

(52) U.S. Cl.
CPC ..... *F04C 29/0057* (2013.01); *F04C 18/0215* (2013.01); *F04C 2240/605* (2013.01); *F04C 2240/807* (2013.01)

(58) Field of Classification Search
CPC ..... F04C 29/0057; F04C 18/0215; F04C 2240/605; F04C 2240/807
See application file for complete search history.

(56) References Cited

U.S. PATENT DOCUMENTS 5,378,129 A 1/1995 Dunaevsky et al.

FOREIGN PATENT DOCUMENTS

CN 1629486 A 6/2005
CN 102165196 A 8/2011
(Continued)

OTHER PUBLICATIONS

Foeign patent publication with machine translation for Chinese Patent Publication CN-205207069-U, Inventor: Wang et al., Title: a fixed displacement swash plate type compressor of the refrigeration system of the car air conditioning system, Patent Published: May 4, 2016. (Year: 2016).*

(Continued)

*Primary Examiner* — Mary Davis
(74) *Attorney, Agent, or Firm* — Christensen O'Connor Johnson Kindness PLLC

(57) ABSTRACT

An orbiting scroll plate driving assembly provided by the present application includes a main shaft (7), a tail driving shaft (6), and an eccentric shaft sleeve (5). The tail driving shaft (6) is eccentrically connected to the main shaft (7), and the eccentric shaft sleeve (5) is rotatably sleeved on the tail driving shaft (6). The orbiting scroll plate driving assembly further includes a limiting portion (14). The limiting portion (14) is disposed on the tail driving shaft (6), and provided with a first limiting portion protrusion (141). The eccentric (Continued)

shaft sleeve (5) is provided with an eccentric shaft sleeve groove (51). The first limiting portion protrusion (141) is correspondingly inserted into the eccentric shaft sleeve groove. A circumferential size of the eccentric shaft sleeve groove (51) is larger than a circumferential size of the first limiting portion protrusion (141). By providing the limiting portion (14) on the tail driving shaft (6), and providing a mortise joint structure between the limiting portion (14) and the eccentric shaft sleeve (5), the circumferential movement and axial movement of the eccentric shaft sleeve (5) can be confined, and the assembly and processing are simple. Further, a scroll compressor is disclosed.

12 Claims, 8 Drawing Sheets

(56) References Cited

FOREIGN PATENT DOCUMENTS

| | | | | | |
|---|---|---|---|---|---|
| CN | 102678563 | A | | 9/2012 | |
| CN | 206092405 | U | | 4/2017 | |
| CN | 104033384 | B | * | 9/2017 | ..... F04C 18/0215 |
| CN | 109185133 | A | | 1/2019 | |
| CN | 208885525 | U | | 5/2019 | |
| CN | 110319003 | A | | 10/2019 | |
| JP | H08159054 | A | | 6/1996 | |
| JP | 1999117877 | A | | 4/1999 | |
| JP | 2002031067 | A | | 1/2002 | |
| JP | 4134783 | B2 | | 10/2004 | |
| JP | 5394225 | B2 | | 1/2014 | |
| JP | 2014190244 | A | | 10/2014 | |
| WO | 2018159143 | A1 | | 9/2018 | |

OTHER PUBLICATIONS

Extended European Search Report dated Jun. 13, 2022, issued in corresponding European Application No. EP 20 83 6534, filed Jun. 30, 2020, 73 pages.

PCT International Searching Authority, International Search Report dated Sep. 29, 2020, issued in corresponding International Application No. PCT/CN2020/099273, filed Jun. 30, 2020, 3 pages.

* cited by examiner

ORBITING SCROLL PLATE DRIVING ASSEMBLY AND SCROLL COMPRESSOR

CROSS-REFERENCE TO RELATED APPLICATION

This application is a National Stage of International Application No. PCT/CN2020/099273, filed Jun. 30, 2020, which claims priority of China Patent Application No. 201910611799.0, filed on Jul. 8, 2019, entitled "ORBITING SCROLL PLATE DRIVING ASSEMBLY AND SCROLL COMPRESSOR", the content of which are hereby incorporated by reference in its entirety.

TECHNICAL FIELD

The present application relates to the technical field of scroll compressors, and more particularly relates to an orbiting scroll plate driving assembly and a scroll compressor.

BACKGROUND

With an orbital radius of an orbiting scroll plate orbiting around a fixed scroll plate varies correspondingly, a proper contact force between the orbiting and fixed scroll teeth in the radial direction thereof can be achieved, thereby improving reliability of the scroll compressor.

For conventional orbiting and fixed scroll structures, a shaft sleeve is typically inserted into an orbiting scroll plate driving bearing, and the shaft sleeve is eccentrically provided with a cylindrical hole to engage with the orbiting scroll plate driving bearing. An end of a main driving shaft is engaged with a tail driving shaft which is installed in the cylindrical hole of the shaft sleeve. The central axis of the tail driving shaft is eccentrically arranged with respect to the central axis of the main driving shaft, and the shaft sleeve can rotate freely within a certain angle range with respect to the tail driving shaft. When a driving motor drives the crankshaft to rotate, the eccentric shaft sleeve can eccentrically drive the orbiting scroll plate to orbit around the fixed scroll plate with respect to the center of the crankshaft, and meanwhile the orbital radius of the orbiting scroll plate can be adjusted when the eccentric shaft sleeve rotates relative to a drive pin.

In a traditional compressor using the technology of the conventional orbiting and fixed scroll structures, although the effect of improving the reliability of the compressor can be achieved by adjusting the orbital radius of the orbiting scroll plate, the structure of the compressor is complicated, the involved parts are numerous, and the manufacturing cost is high, which is mainly reflected in the following two points:

First, in order to realize the free rotation of the eccentric shaft sleeve within a certain range with respect to the tail driving shaft, the rotation of the eccentric shaft sleeve needs to be confined within the certain range. The current technology adopts a cooperative pin and hole to limit the position, i.e., disposing a hole and a limiting pin at the eccentric shaft sleeve and at the end of the crankshaft. In addition, in order to eliminate the impact noise between the limiting pin and the hole when the compressor is turned on and turned off, the limiting pin or the hole is provided with an elastic silencing member, which involves a matching hole, a limiting pin, a pin installation hole, an elastic member and so on.

Second, the eccentric shaft sleeve is prone to escape upward with respect to the tail driving shaft when driving the orbiting scroll plate. Therefore, the eccentric shaft sleeve needs to be axially limited, and a limiting member needs to be installed on an upper end of the tail driving shaft.

In general, in conventional technology, in order to adjust the orbital radius of the orbiting scroll plate, it is necessary to separately provide circumferential limiting and axial limiting structures for the eccentric shaft sleeve. However, these structures involve many problems such as numerous parts, and complicated machining and assembly processes.

SUMMARY

Therefore, the technical problem to be solved by the present application is to provide an orbiting scroll plate driving assembly and a scroll compressor that can limit the circumferential movement of the eccentric shaft sleeve thereof.

In order to solve the above problem, the present application provides an orbiting scroll plate driving assembly, which includes a main shaft, a tail driving shaft, and an eccentric shaft sleeve. The tail driving shaft is eccentrically connected to the main shaft, and the eccentric shaft sleeve is rotatably sleeved on the tail driving shaft. The orbiting scroll plate driving assembly further includes a limiting portion. The limiting portion is disposed on the tail driving shaft, and provided with a first limiting portion protrusion. The eccentric shaft sleeve is provided with an eccentric shaft sleeve groove. The first limiting portion protrusion is correspondingly inserted into the eccentric shaft sleeve groove. A circumferential size of the eccentric shaft sleeve groove is larger than a circumferential size of the first limiting portion protrusion. Alternatively, the limiting portion is provided with a first limiting portion groove. The eccentric shaft sleeve is provided with a first eccentric shaft sleeve protrusion. The first eccentric shaft sleeve protrusion is correspondingly inserted into the first limiting portion groove. A circumferential size of the first limiting portion groove is larger than a circumferential size of the first eccentric shaft sleeve protrusion.

In an embodiment, the limiting portion includes an annular body, and the annular body is disposed on an end of the tail driving shaft.

In an embodiment, an outer diameter of the annular body is larger than an outer diameter of the tail driving shaft. The eccentric shaft sleeve is provided with an annular groove receiving a portion of the annular body.

In an embodiment, an outer diameter of the annular body is less than or equal to an outer diameter of the tail driving shaft.

In an embodiment, the first limiting portion groove includes a gap defined by the annular body. The first eccentric shaft sleeve protrusion is correspondingly inserted into the gap.

In an embodiment, the limiting portion is provided with a second limiting portion protrusion, the tail driving shaft is provided with a tail driving shaft groove, and the second limiting portion protrusion is fixedly connected to the tail driving shaft groove; or the limiting portion is provided with a second limiting portion groove, the tail driving shaft is provided with a first tail driving shaft protrusion, and the second limiting portion groove is fixedly connected to the first tail driving shaft protrusion.

In an embodiment, the second limiting portion protrusion or the second limiting portion groove includes an axial portion and a radial portion. The axial portion is arranged toward the tail driving shaft in an axial direction of the limiting portion, and the radial portion is arranged toward a center of the annular body in a radial direction of the limiting portion.

In an embodiment, a circumferential side wall of the first limiting portion protrusion or a circumferential side wall of the eccentric shaft sleeve groove is provided with a shock-absorbing member.

In an embodiment, both of a circumferential side wall of the first limiting portion protrusion and a circumferential side wall of the eccentric shaft sleeve groove are respectively provided with shock-absorbing members.

In an embodiment, both of a circumferential side wall of the first limiting portion groove and a circumferential side wall of the first eccentric shaft sleeve protrusion are respectively provided with shock-absorbing members.

In an embodiment, a circumferential side wall of the first limiting portion groove or a circumferential side wall the first eccentric shaft sleeve protrusion is provided with a shock-absorbing member.

In an embodiment, the shock-absorbing member includes a shock-absorbing coating.

According to another aspect of the present application, a scroll compressor is provided, which includes the orbiting scroll plate driving assembly as described above.

The orbiting scroll plate driving assembly provided by the present application includes a main shaft, a tail driving shaft, and an eccentric shaft sleeve. The tail driving shaft is eccentrically connected to the main shaft, and the eccentric shaft sleeve is rotatably sleeved on the tail driving shaft. The orbiting scroll plate driving assembly further includes a limiting portion. The limiting portion is disposed on the tail driving shaft, and provided with a first limiting portion protrusion. The eccentric shaft sleeve is provided with an eccentric shaft sleeve groove. The first limiting portion protrusion is correspondingly inserted into the eccentric shaft sleeve groove. A circumferential size of the eccentric shaft sleeve groove is larger than a circumferential size of the first limiting portion protrusion. By providing the limiting portion on the tail driving shaft, and providing a mortise joint structure between the limiting portion and the eccentric shaft sleeve, the circumferential movement and axial movement of the eccentric shaft sleeve can be confined, and the assembly and processing are simple.

DESCRIPTION OF REFERENCE SIGNS

Figure 1:
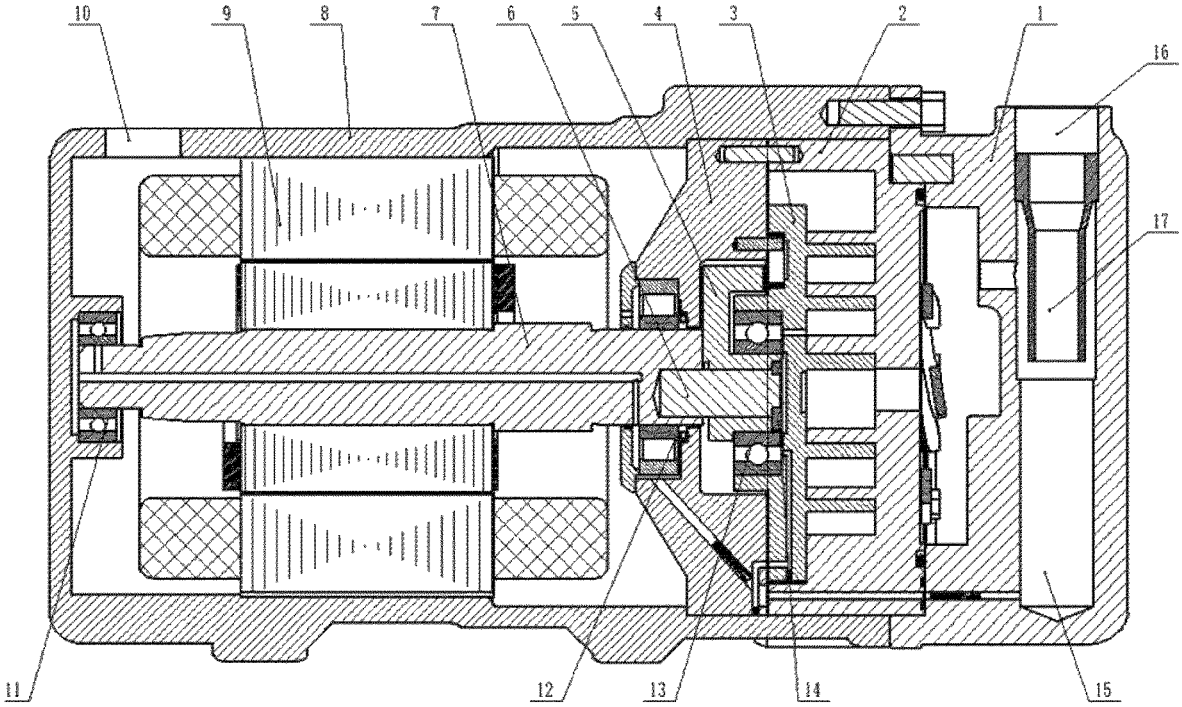
FIG. 1 is a cross-sectional view of a scroll compressor according to an embodiment of the present application.
Figure 2:
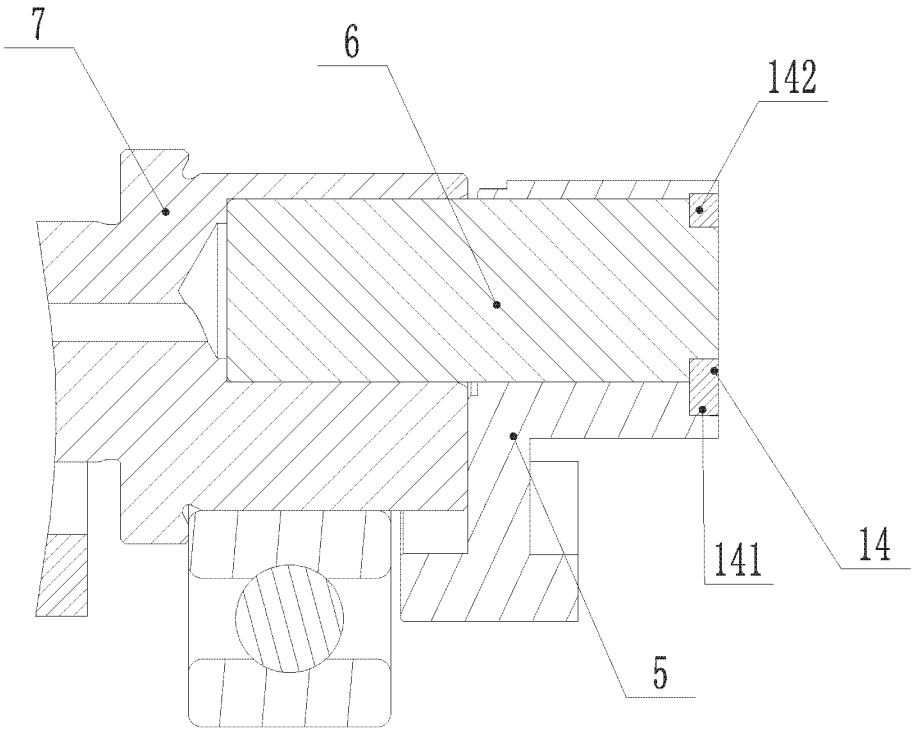
FIG. 2 is a partial enlarged view of FIG. 1 according to an embodiment of the present application.

1, upper cover; 2, fixed scroll plate; 3, orbiting scroll plate; 31, center of the orbiting scroll plate; 4, upper bracket; 5, eccentric shaft sleeve; 51, eccentric shaft sleeve groove; 52, eccentric shaft sleeve axial limiting portion; 53, inner hole of the eccentric shaft sleeve; 54, eccentric shaft sleeve protrusion; 6, tail driving shaft; 61, tail driving shaft groove; 62, installation portion for the limiting portion; 7, main driving shaft; 71, rotation center of the main driving shaft (center of the fixed scroll plate); 8, housing; 9, driving motor; 10, gas suction port of the housing; 11, secondary bearing; 12, main bearing; 13, orbiting scroll plate driving bearing; 14, limiting portion; 141, first limiting portion protrusion; 142, second limiting portion protrusion; 143, limiting portion gap; 144, shock-absorbing member; 15, oil sump hole of the upper cover; 16, gas exhaustion port of the housing; 17, exhaustion gas-oil separator; D1, first orbital radius of the orbiting and fixed scroll plates; D2, second orbital radius of the orbiting and fixed scroll plates; D3, third orbital radius of the orbiting and fixed scroll plates.

DETAILED DESCRIPTION

In order to make the above objects, features and advantages of the present disclosure more apparent, specific embodiments of the present application will be described in detail with reference to the accompanying drawings. Numerous specific details are set forth in the description below in order to provide a thorough understanding of the present application. However, the present application can be implemented in many other ways than those described herein, and those skilled in the art can make similar modifications without departing from the scope of the present application, and thus the present application is not limited by the specific embodiments disclosed below.

It can be understood that when an element is referred to as being "disposed" or "provided" on another element, it can be directly on the other element or intervening elements may be present. When an element is referred to as being "connected" or "coupled" to another element, it can be directly connected or coupled to another element or intervening elements may be present. The terms "vertical", "horizontal", "left", "right", and the like, as used herein, are for illustrative purposes only and are not intended to be limited as the only embodiment.

Unless otherwise defined, all technical and scientific terms used herein have the same meanings as those commonly understood by those skilled in the art belonging to the technical field of the present application. The terms used in the specification of the present application herein are only for the purpose of describing specific embodiments, and are not intended to limit the present application. The technical features in the embodiments can be combined arbitrarily. In order to make the description brief, all possible combinations of the technical features in the embodiments are not described. However, the combinations of the technical features shall be considered to belong to the scope of protection of the present application as long as there is no contradiction among them.

In addition, it should also be understood that in the embodiments, the positional relationship indicated by the terms "upper", "lower", "front", "rear", "left", "right", "inner", "outer", "top", "bottom", "one side", "another side", "one end", "another end" and the like are based on the positional relationship shown in the drawings. The terms "first", "second" and the like are used to distinguish different structural members. These terms are only for facilitating to describe the present application and to simplify the description thereof, and cannot be construed as limitations on the present application.

With reference to FIGS. 2 to 12, according to an embodiment of the present application, an orbiting scroll plate driving assembly includes a main driving shaft 7, a tail driving shaft 6, and an eccentric shaft sleeve 5. The tail driving shaft 6 is eccentrically connected to the main driving shaft 7. The eccentric shaft sleeve 5 is rotatably sleeved on the tail driving shaft 6. The orbiting scroll plate driving assembly further includes a limiting portion 14. The limiting portion 14 is disposed on the tail driving shaft 6, and provided with a first limiting portion protrusion 141. The eccentric shaft sleeve 5 is provided with an eccentric shaft sleeve groove 51. The first limiting portion protrusion 141 is correspondingly inserted into the eccentric shaft sleeve groove 51. The width of the eccentric shaft sleeve groove 51 is larger than the width of the first limiting portion protrusion 141.

Two ends of the main driving shaft 7 are disposed in a housing 8 and supported by a main bearing 12 and a secondary bearing 11. A driving motor 9 drives the main driving shaft 7 to rotate. The tail driving shaft 6 is eccentrically connected to the main driving shaft 7. The tail driving shaft 6 and the main driving shaft 7 can be an integration or separate parts. The following description takes the two shafts being separate parts as an example.

The eccentric shaft sleeve 5 is sleeved on the tail driving shaft 6, and is disposed in an orbiting scroll plate driving bearing 13 by interference fit. The eccentric shaft sleeve 5 can rotate freely (within a certain range) around the tail driving shaft 6, and drive an orbiting scroll plate 3 to orbit relative to a fixed scroll plate 2. In the housing 8, the volume of the compression chamber defined by the fixed scroll plate 2 and the orbiting scroll plate 3 increases and decreases periodically to compress refrigerant, thereby resulting in the continuous compression of the refrigerant sucked into the compression chamber. The refrigerant is introduced from a gas suction port 10 of the housing 8, compressed by the pump, then passed through an oil sump hole 15 of an upper cover and an exhaustion gas-oil separator 17, and then discharged from a gas exhaustion port 16 of the housing 8.

As shown in FIGS. 2 to 8, the limiting portion 14 is installed or disposed on an upper end of the tail driving shaft 6, and that is, the limiting portion 14 is located between the eccentric shaft sleeve 5 and the orbiting scroll plate 3. The upper end of the tail driving shaft 6 is provided with an installation portion 62 for the limiting portion 14. The installation portion 62 has a relatively small size and is configured to install the limiting portion 14. The limiting portion 14 is assembled on the installation portion 62 by interference fit, so that there is no looseness between the limiting portion 14 and the tail driving shaft 6.

The limiting portion 14 is provided with a first limiting portion protrusion 141 to prevent the eccentric shaft sleeve 5 from escaping upward and axially. An upper end of the eccentric shaft sleeve 5 is provided with an eccentric shaft sleeve groove 51 at a position corresponding to the first limiting portion protrusion 141 and is provided with an eccentric shaft sleeve axial limiting portion 52 configured to receive the limiting portion 14 (referring to FIG. 8). In this case, the outer diameter of an annular body of the limiting portion 14 is larger than the outer diameter of the tail driving shaft 6. The tail driving shaft 6 is inserted in an inner hole 53 of the eccentric shaft sleeve 5 (the inner hole 53 is eccentrically arranged with respect to a driving portion of the orbiting scroll plate driving bearing 13), so that the eccentric shaft sleeve 5 can rotate freely with respect to the tail driving shaft 6.

Figure 3:
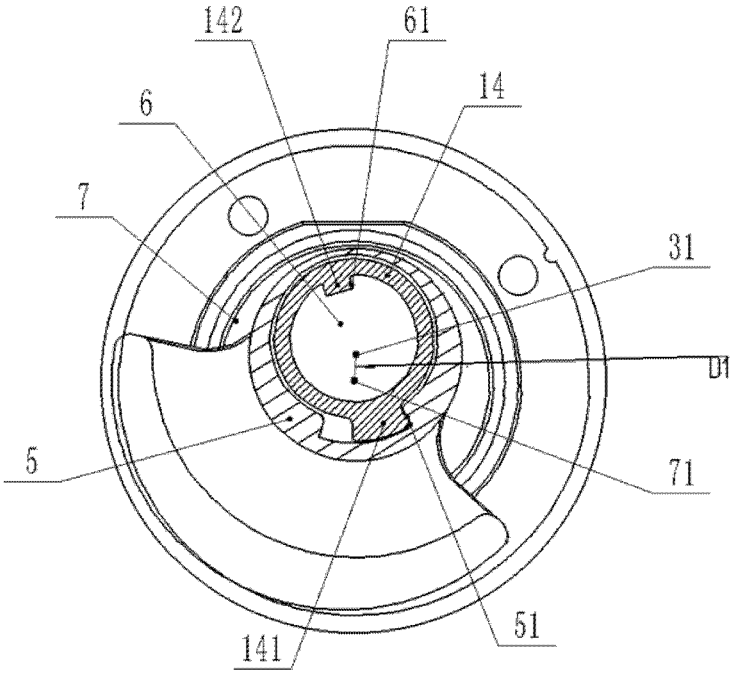
FIG. 3 is a first state view of limiting adjustment of a limiting portion according to an embodiment of the present application.
Figure 4:
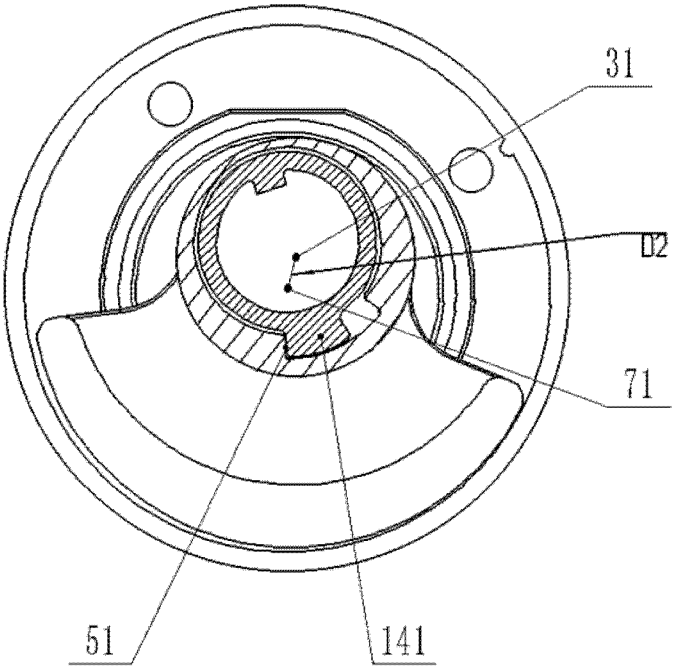
FIG. 4 is a second state view of limiting adjustment of the limiting portion according to an embodiment of the present application.
Figure 5:
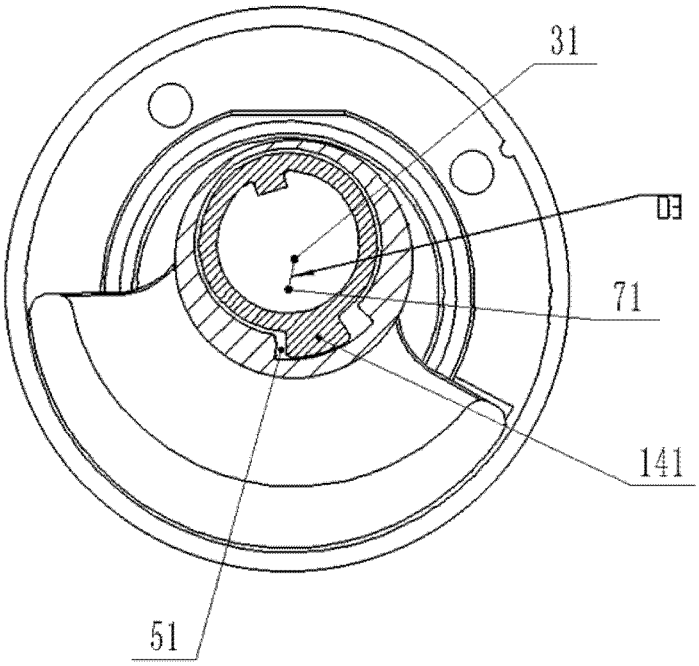
FIG. 5 is a third state view of limiting adjustment of the limiting portion according to an embodiment of the present application.
Figure 6:
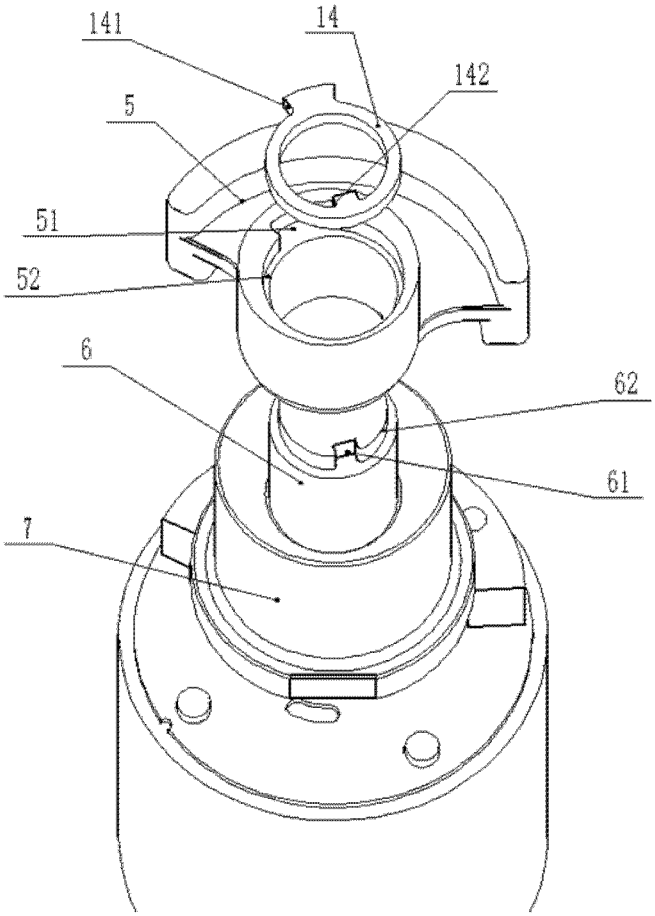
FIG. 6 is an exploded structural view of an eccentric shaft sleeve and the limiting portion according to an embodiment of the present application.
Figure 7:
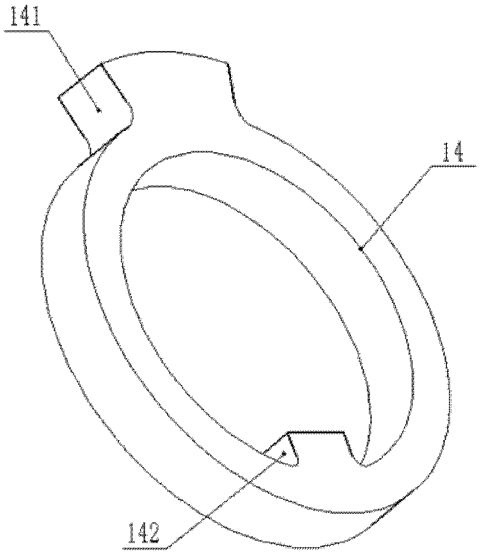
FIG. 7 is a structural view of the limiting portion according to an embodiment of the present application.
Figure 8:
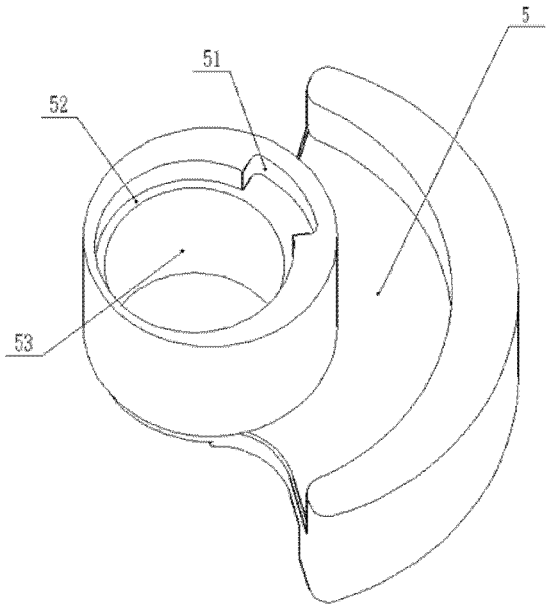
FIG. 8 is a structural view of the eccentric shaft sleeve according to an embodiment of the present application.
Figure 9:
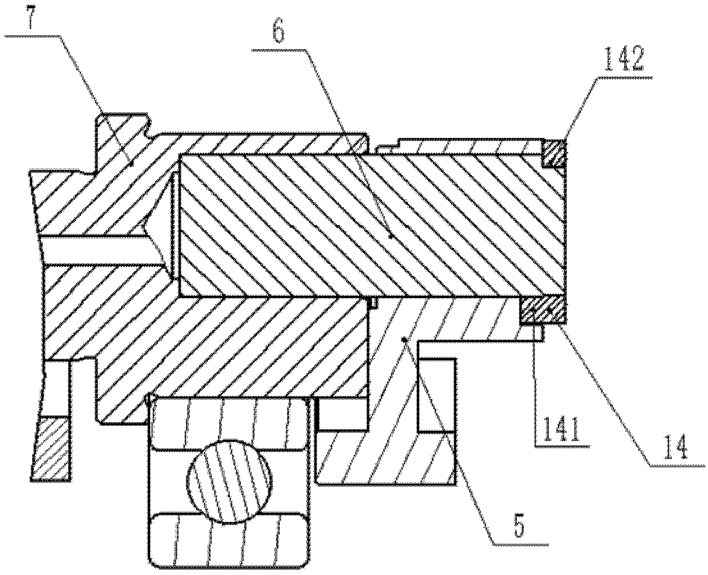
FIG. 9 is a partial enlarged view of FIG. 1 according to another embodiment of the present application.
Figure 10:
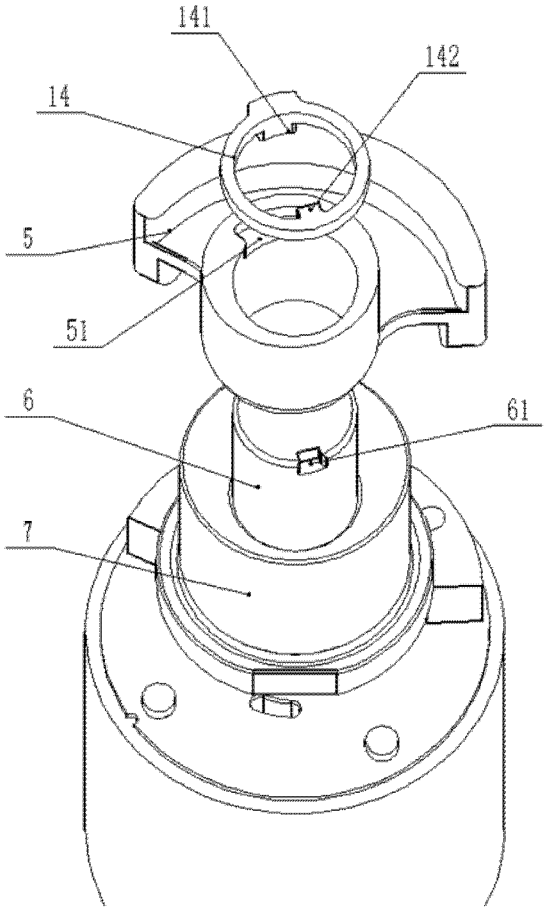
FIG. 10 is an exploded structural view of the eccentric shaft sleeve and the limiting portion according to another embodiment of the present application.

FIGS. 3 to 5 illustrate the principle of circumferential limiting of the eccentric shaft sleeve 5 by the limiting portion 14. FIGS. 3 and 4 show two limit states formed by the cooperation of the first limiting portion protrusion 141 and eccentric shaft sleeve groove 51. In the two limit states, the distance D between the center 71 of the fixed scroll plate 2 and the center 31 of the orbiting scroll plate 3 has two different limit values. Therefore, due to the existence of the limiting portion 14, the free rotation of the eccentric shaft sleeve 5 with respect to the tail driving shaft 6 is restricted within the range between the two positions shown in FIGS. 2 and 3. FIG. 5 shows a certain middle position. Therefore, due to the limiting portion 14 of the present application, the axial position of the eccentric shaft sleeve 5 is restricted, and the circumferential position is also restricted. The orbital radius of the orbiting and fixed scroll plates 2, 3, i.e., the third radius D3, is restricted between a first orbital radius D1 of the orbiting and fixed scroll plates 2, 3 and a second orbital radius D2 of the orbiting and fixed scroll plates 2, 3 that are previously determined, thereby achieving the effect of reducing the number of parts compared with the prior art.

Similar to the above-described mortise joint between the first limiting portion protrusion 141 and the eccentric shaft sleeve groove 51, the limiting portion 14 can alternatively be provided with a first limiting portion groove, and the eccentric shaft sleeve 5 can alternatively be provided with a first eccentric shaft sleeve protrusion. The first eccentric shaft sleeve protrusion is correspondingly inserted into the first limiting portion groove. The width of the first limiting portion groove is larger than the width of the first eccentric shaft sleeve protrusion.

The limiting portion 14 is provided with a second limiting portion protrusion 142, and the tail driving shaft 6 is provided with a tail driving shaft groove 61. The second limiting portion protrusion 142 is fixedly connected, e.g., by interference fit, to the tail driving shaft groove 61. Alternatively, the limiting portion 14 is provided with a second groove, and the tail driving shaft 6 is provided with a protrusion structure. The second groove of the limiting portion 14 is fixedly connected, e.g., by interference fit, to the protrusion structure of the tail driving shaft 6. When the limiting portion 14 is fixedly disposed on the tail driving shaft 6, and in particular, when the upper end of the eccentric shaft sleeve 5 is not suitable to provide with the eccentric shaft sleeve axial limiting portion 52 (e.g., when the eccentricity of the inner hole 53 of the eccentric shaft sleeve 5 is large, and the inner hole 53 of the eccentric shaft sleeve 5 is arranged close to an outer edge of the driving portion of the orbiting scroll plate driving bearing 13), the second limiting portion protrusion 142 can further include a radial protrusion and an axial protrusion. In this case, comparing FIG. 2 with FIG. 9, it can be seen that the limiting portion 14 can be disposed outside the end of the eccentric shaft sleeve 5 if it cannot be embedded in the end of the eccentric shaft sleeve 5. In this configuration, the installation portion 62 for the limiting portion 14 can also be smaller or be eliminated from the upper end of the tail driving shaft 6, thereby enhancing the strength of the tail driving shaft 6.

Figure 11:
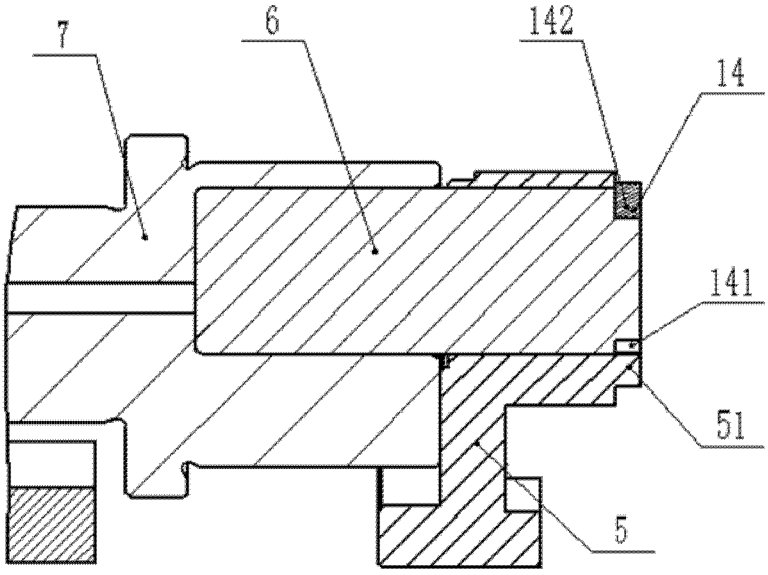
FIG. 11 is an exploded structural view of the eccentric shaft sleeve and the limiting portion according to a third embodiment of the present application.
Figure 12:
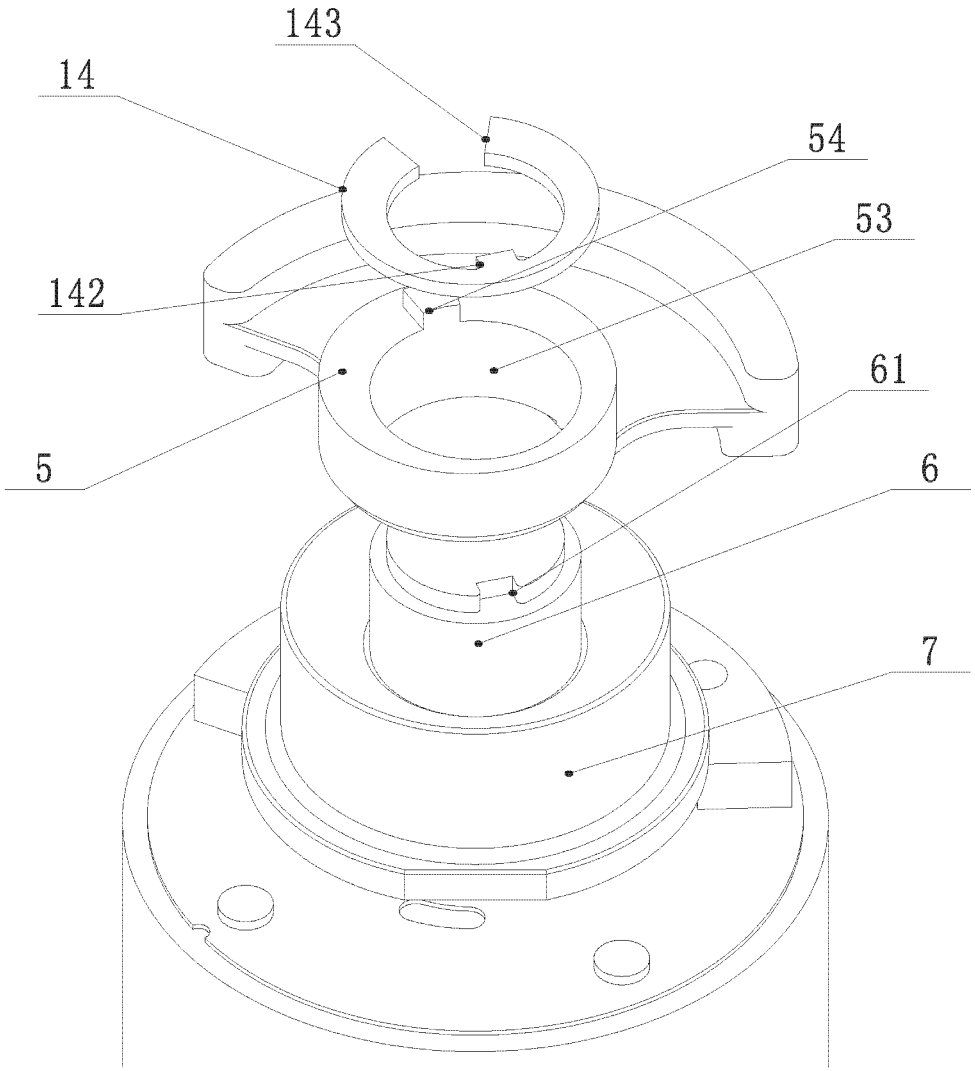
FIG. 12 is a structural view of a shock-absorbing member of the limiting portion according to an embodiment of the present application.

The eccentric shaft sleeve 5 can be axially limited by a limiting portion gap 143 of the limiting portion 14 and the eccentric shaft sleeve protrusion 54 of the eccentric shaft sleeve 5, as shown in FIGS. 11 and 12. In addition, the limiting portion 14 is installed on the smaller portion of the upper end of the tail driving shaft 6. In this case, the outer diameter of the annular body of the limiting portion 14 is less than or equal to the outer diameter of the tail driving shaft 6.

Figure 13:
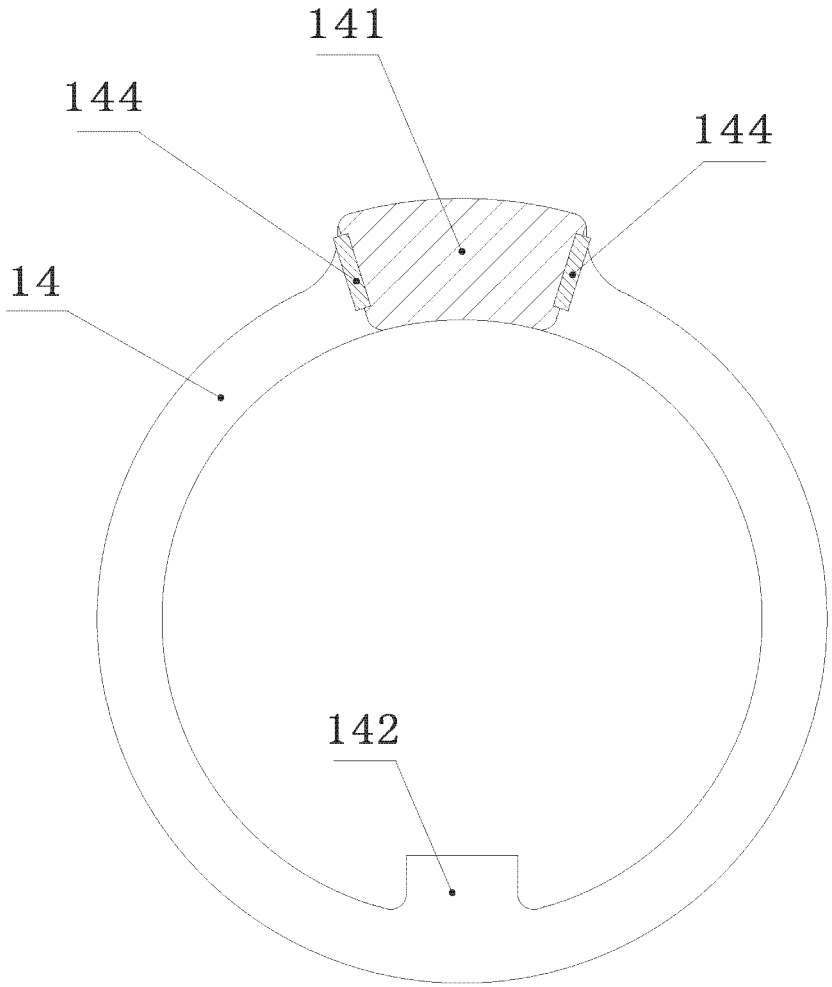
FIG. 13 is another structural view of the limiting portion according to an embodiment of the present application.

In the two states shown in FIGS. 3 and 4, which are commonly in the turning on stage and the turning off stage of the compressor, the position limiting induces noise caused by the impact. There are several ways to reduce this impact noise: First, the limiting portion 14 itself can be made of a shock-absorbing material, such as engineering plastics (that is, it not only meets the strength requirements but also make less noise than the metal). Second, the limiting portion 14 is made of a metal material, but both sides of the first limiting portion protrusion 141 are respectively provided with shock-absorbing coatings formed by spraying, implanting, covering, or the like. Third, the first limiting portion protrusion 141 is made of a shock-absorbing material, whereas other portions of the limiting portion 14 are made of a metal material. In addition, the axial limiting section between the limiting portion 14 and the eccentric shaft sleeve 5 can be provided with a lubricating coating, so that the eccentric shaft sleeve 5 can rotate within the range with less resistance (there is a certain gap between the limiting portion 14 and the eccentric shaft sleeve 5 in an axial direction during normal assembly when the upper end of the eccentric shaft sleeve 5 abuts against the limiting portion 14), as shown in FIG. 13.

Optionally, a circumferential side wall of the first limiting portion protrusion 141 or a circumferential side wall of the eccentric shaft sleeve groove 51 is provided with a shock-absorbing member 144, which can serve the purpose of shock-absorbing. As an example, the shock-absorbing member 144 is located on a circumferential surface of the first limiting portion protrusion 141. Optionally, both circumferential side walls of the first limiting portion protrusion 141 and the eccentric shaft sleeve groove 51 are provided with the shock-absorbing members 144. Optionally, both circumferential side walls of the first limiting portion groove and the first eccentric shaft sleeve protrusion are provided with the shock-absorbing members 144. Optionally, the circumferential side wall of the first limiting portion groove or the circumferential side wall the first eccentric shaft sleeve protrusion is provided with the shock-absorbing member 144. It should be noted that any member used for shock-absorbing between the limiting portion 14 and the eccentric shaft sleeve 5 can be the shock-absorbing member 144.

Optionally, the shock-absorbing member 144 includes a shock-absorbing coating. The present application replaces the conventional circumferential and axial limiting structures for the eccentric shaft sleeve 5 with the limiting portion 14, so as to reduce the quantity of parts, and simplify the machining process and assembly process.

With reference to FIG. 1, according to an embodiment of the present application, a scroll compressor includes the above-mentioned orbiting scroll plate driving assembly. The orbiting scroll driving assembly is disposed in the housing 8, and rotates by a crankshaft driven by the driving motor 9. The secondary bearing 11 is fixed to the housing 8 through an upper bracket 4. An upper cover 1 is covered on the housing 8 to form a relatively-closed sealing structure.

It is easily understood by those skilled in the art that the above embodiments can be combined and superimposed freely without conflict.

The above descriptions are only preferred embodiments of the present application, but they should not be construed as limiting the scope of the present application. Any modification, equivalent replacement and improvement made within the spirit and principle of the present application shall fall within the protection scope of the present application. The above descriptions are only the preferred embodiments of the present application. It should be understood by those of ordinary skill in the art that various modifications and improvements can be made without departing from the concept of the present application, and all fall within the protection scope of the present application.

What is claimed is:

1. An orbiting scroll plate driving assembly, comprising:

a main shaft, a tail driving shaft, and an eccentric shaft sleeve, the tail driving shaft being eccentrically connected to the main shaft, and the eccentric shaft sleeve being rotatably sleeved on the tail driving shaft;

wherein the orbiting scroll plate driving assembly further comprises a limiting portion, the limiting portion is disposed on the tail driving shaft, the limiting portion comprises an annular body, the annular body is disposed on an end of the tail driving shaft, an outer diameter of the annular body is larger than an outer diameter of the tail driving shaft, the eccentric shaft sleeve is provided with an annular groove receiving a portion of the annular body, and the limiting portion is provided with a first limiting portion protrusion, the eccentric shaft sleeve is provided with an eccentric shaft sleeve groove, the first limiting portion protrusion is correspondingly inserted into the eccentric shaft sleeve groove, and a circumferential size of the eccentric shaft sleeve groove is larger than a circumferential size of the first limiting portion protrusion; or the limiting portion is provided with a first limiting portion groove, the eccentric shaft sleeve is provided with a first eccentric shaft sleeve protrusion, the first eccentric shaft sleeve protrusion is correspondingly inserted into the first limiting portion groove, and a circumferential size of the first limiting portion groove is larger than a circumferential size of the first eccentric shaft sleeve protrusion.

2. The orbiting scroll plate driving assembly according to claim 1, wherein the first limiting portion groove comprises a gap defined by the annular body; and the first eccentric shaft sleeve protrusion is correspondingly inserted into the gap.

3. The orbiting scroll plate driving assembly according to claim 1, wherein the limiting portion is provided with a second limiting portion protrusion, the tail driving shaft is provided with a tail driving shaft groove, and the second limiting portion protrusion is fixedly connected to the tail driving shaft groove.

4. The orbiting scroll plate driving assembly according to claim 3, wherein the second limiting portion protrusion comprises an axial portion and a radial portion; the axial portion is arranged toward the tail driving shaft in an axial direction of the limiting portion, and the radial portion is arranged toward a center of the annular body in a radial direction of the limiting portion.

5. The orbiting scroll plate driving assembly according to claim 1, wherein a circumferential side wall of the first limiting portion protrusion or a circumferential side wall of the eccentric shaft sleeve groove is provided with a shock-absorbing member.

6. The orbiting scroll plate driving assembly according to claim 5, wherein the shock-absorbing member comprises a shock-absorbing coating.

7. The orbiting scroll plate driving assembly according to claim 1, wherein both of a circumferential side wall of the first limiting portion protrusion and a circumferential side wall of the eccentric shaft sleeve groove are provided with a shock-absorbing member.

8. The orbiting scroll plate driving assembly according to claim 1, wherein both of a circumferential side wall of the first limiting portion groove and a circumferential side wall of the first eccentric shaft sleeve protrusion are provided with a shock-absorbing member.

9. The orbiting scroll plate driving assembly according to claim 1, wherein a circumferential side wall of the first limiting portion groove or a circumferential side wall the first eccentric shaft sleeve protrusion is provided with a shock-absorbing member.

10. A scroll compressor, comprising the orbiting scroll plate driving assembly according to claim 1.

11. An orbiting scroll plate driving assembly, comprising:

a main shaft, a tail driving shaft, and an eccentric shaft sleeve, the tail driving shaft being eccentrically connected to the main shaft, and the eccentric shaft sleeve being rotatably sleeved on the tail driving shaft;

wherein the orbiting scroll plate driving assembly further comprises a limiting portion, the limiting portion is disposed on the tail driving shaft, the limiting portion comprises an annular body, and the annular body is disposed on an end of the tail driving shaft, the limiting portion is provided with a first limiting portion groove, the eccentric shaft sleeve is provided with a first eccentric shaft sleeve protrusion, the first eccentric shaft sleeve protrusion is correspondingly inserted into the first limiting portion groove, and a circumferential size of the first limiting portion groove is larger than a circumferential size of the first eccentric shaft sleeve protrusion; and an outer diameter of the annular body is less than or equal to an outer diameter of the tail driving shaft.

12. An orbiting scroll plate driving assembly, comprising:

a main shaft, a tail driving shaft, and an eccentric shaft sleeve, the tail driving shaft being eccentrically connected to the main shaft, and the eccentric shaft sleeve being rotatably sleeved on the tail driving shaft;

wherein the orbiting scroll plate driving assembly further comprises a limiting portion, the limiting portion is disposed on the tail driving shaft, the limiting portion comprises an annular body, the annular body is disposed on an end of the tail driving shaft, an outer diameter of the annular body is larger than an outer diameter of the tail driving shaft, the eccentric shaft sleeve is provided with an annular groove receiving a portion of the annular body;

the limiting portion is provided with a first limiting portion groove, the eccentric shaft sleeve is provided with a first eccentric shaft sleeve protrusion, the first eccentric shaft sleeve protrusion is correspondingly inserted into the first limiting portion groove, and a circumferential size of the first limiting portion groove is larger than a circumferential size of the first eccentric shaft sleeve protrusion; and the first limiting portion groove comprises a gap defined by the annular body; and the first eccentric shaft sleeve protrusion is correspondingly inserted into the gap.

* * * * *